US006263663B1

(12) United States Patent
Grienche et al.

(10) Patent No.: US 6,263,663 B1
(45) Date of Patent: Jul. 24, 2001

(54) VARIABLE-THROAT GAS-TURBINE COMBUSTION CHAMBER

(75) Inventors: Guy Grienche, Coarraze; Gérard Schott, Rontignon; Jean-Hervé Le Gal, Paris; Gérard Martin, Saint Genis Laval; Patrice Laborde, Bollène; Raphaël Spagna, Lescar, all of (FR)

(73) Assignees: Institut Francais du Petrole, Rueil-Malmaison Cedex; Turbomeca, Bodes, both of (FR)

( * ) Notice: Subject to any disclaimer, the term of this patent is extended or adjusted under 35 U.S.C. 154(b) by 0 days.

(21) Appl. No.: 09/330,199

(22) Filed: Jun. 11, 1999

(30) Foreign Application Priority Data

Jun. 11, 1998 (FR) ..... 98 07409

(51) Int. Cl.[7] ..... F02C 9/00
(52) U.S. Cl. ..... 60/39.29
(58) Field of Search ..... 60/39.23, 39.29

(56) References Cited

U.S. PATENT DOCUMENTS 3,691,761 9/1972 Jackson .
3,765,171 10/1973 Hagen .
3,869,246 3/1975 Hamond, Jr. .
4,296,599 10/1981 Adamson .
5,069,029 * 12/1991 Kuroda et al. ..... 60/39.06
5,159,807 11/1992 Forestier .

FOREIGN PATENT DOCUMENTS 281961 9/1988 (EP) .
2270448 12/1975 (FR) .

* cited by examiner

*Primary Examiner*—Charles G. Freay
*Assistant Examiner*—Ehud Gartenberg
(74) *Attorney, Agent, or Firm*—Antonelli, Terry & Kraus, LLP

(57) ABSTRACT

The present invention relates to a gas-turbine combustion chamber comprising at least a zone (11) referred to as pilot combustion zone into which at least a first pilot fuel injection means (3) and an associated first oxidizer injection means (4) open; a main combustion zone (12) into which at least a second main fuel injection means (7) and an associated second oxidizer injection means (8) open, all of it being maintained under a pressure P1 inside an enclosure (14). According to the invention, said chamber further comprises a mechanical means (15–19) for controlling the second flow of oxidizer, which reacts to the pressure difference between the inside (P1) and the atmospheric pressure (Po) outside enclosure (14), said pressure difference being directly linked with the engine speed.

9 Claims, 4 Drawing Sheets

VARIABLE-THROAT GAS-TURBINE COMBUSTION CHAMBER

FIELD OF THE INVENTION

The present invention relates to the field of gas turbines and more particularly to combustion chambers associated with such turbines.

BACKGROUND OF THE INVENTION

One of the problems at the root of the present invention concerns the pollution generated by the operation of these turbines. More precisely, nitrogen oxides (NOx) and carbon monoxide (CO) emissions must be reduced because they are the most harmful to the environment.

Furthermore, rather stringent standards are in force or will come into force in most industrialized countries.

Nitrogen oxides (NOx) are mainly thermal nitrogen oxides that form at high temperature, i.e. above 1700 K in gas-turbine combustion chambers where the fumes have residence times generally ranging between 2 and 10 milliseconds.

Carbon monoxide (CO) forms at a lower temperature (<1600 K) by incomplete combustion of the fuel.

The optimum temperature range for reduced NOx and CO emissions is thus between about 1650 K and 1750 K. FIG. 1 illustrates, by means of (CO and NOx) curves, the respective carbon monoxide and nitrogen oxides emissions as a function of the temperature T (in K) under the operating conditions of a gas-turbine combustion chamber.

NOx and CO emissions are thus directly linked with the air-fuel mixture strength in the combustion chamber, i.e. the ratio of the flow of air to the flow of fuel. Given that the air-fuel ratio of the mixture must be imposed if one wants to operate within a certain temperature range, such as that mentioned above, the adiabatic flame temperature of the mixture will approximately vary proportionally to the mixture strength.

Conventionally, as it is well-known, the flow of fuel is the only parameter allowing to control the operating conditions of the turbine. For a given flow of fuel, the flow of air is therefore perfectly set to a value depending only on the characteristics of the machine and in particular on the cross-sections of flow in the furnace. The mixture strength is thereafter totally determined.

However, the mixture strength range allowing to respect the temperature range defined above does not always correspond to the mixture strength imposed by the characteristic curve of the machine.

Several concepts can be envisaged to solve this problem.

One of them consists in carrying out a combustion in several stages, ignited successively. This known solution is illustrated by FIG. 2 that shows a combustion chamber having a pilot stage followed by two other stages having each an air inlet and an inlet for a fuel such as natural gas for example. Combustion then has to be performed in each stage successively and according to the total power required. The pilot combustion is carried out whatever the speed. This solution theoretically allows to obtain acceptable mixture strengths in the ignited stages, for each engine speed, if a sufficient number of stages is available. The major drawback is that it requires a complex fuel delivery circuit, hence reliability, control and cost problems.

Another concept allowing to obtain combustion chambers operating in a determined temperature range consists in equipping it with a series of shutters, clappers or other shutoff means allowing to control the flow of air in the furnace. Of course, control and actuation of such elements is complex and delicate to implement. This equipment is furthermore costly.

SUMMARY OF THE INVENTION

The present invention thus aims to propose a reliable and simple solution to the problem of mixture strength control in a gas-turbine combustion chamber.

The object of this control is to be able to carry out combustion in an optimum temperature range notably as regards carbon monoxide and nitrogen oxides emissions.

The present invention thus allows automatic combustion air flow control. A mechanical control system is advantageously achieved by means of a very limited number of mechanical parts.

The object of the invention is a gas-turbine combustion chamber comprising at least a zone referred to as pilot injection zone into which at least a first pilot fuel injection means and an associated first oxidizer injection means open; a main combustion zone into which at least a second main fuel injection means and an associated second oxidizer injection means open, all of it being maintained under a pressure P1 inside an enclosure.

According to the invention, said combustion chamber further comprises a mechanical means for controlling the second flow of oxidizer, which reacts to the pressure difference between the inside (P1) and the atmospheric pressure (Po) outside the enclosure, said pressure difference being directly linked with the engine speed.

More precisely, said control means comprises at least a shutoff element that seals more or less the second air inlets in the combustion chamber, several tie rods between the shutoff elements and a support element, a compression element, a bellows joint placed around the compression element delimiting, with the support element, the volume at the atmospheric pressure (Po) in relation to the enclosure under pressure (P1).

Particularly, the first fuel injection means and the first oxidizer injection means are placed substantially close to the longitudinal axis (XX') of the combustion chamber.

According to a specific layout of the invention, the second main fuel injection means and the second oxidizer injection means are situated on a circumference, downstream from the pilot combustion zone in relation to the direction of propagation of the flame.

Furthermore, the combustion chamber according to the invention comprises a third oxidizer injection means opening into the combustion chamber downstream from the second oxidizer injection means in relation to the direction of propagation of the flame.

Moreover, the means for controlling the second flow of oxidizer allows to control the flow of the third air injection means (bypass function).

The compression element can comprise a pile of washers or springs.

According to an embodiment of the invention, the chamber comprises three zones in which the second main fuel injection means (7) and the main oxidizer injection means (8) are grouped together, each zone lying 120° apart.

BRIEF DESCRIPTION OF THE DRAWINGS

Other advantages, features and details of the invention will be clear from reading the description hereafter, given by way of non limitative example, with reference to the accompanying drawings wherein.

DETAILED DESCRIPTION OF THE INVENTION

Figure 1:
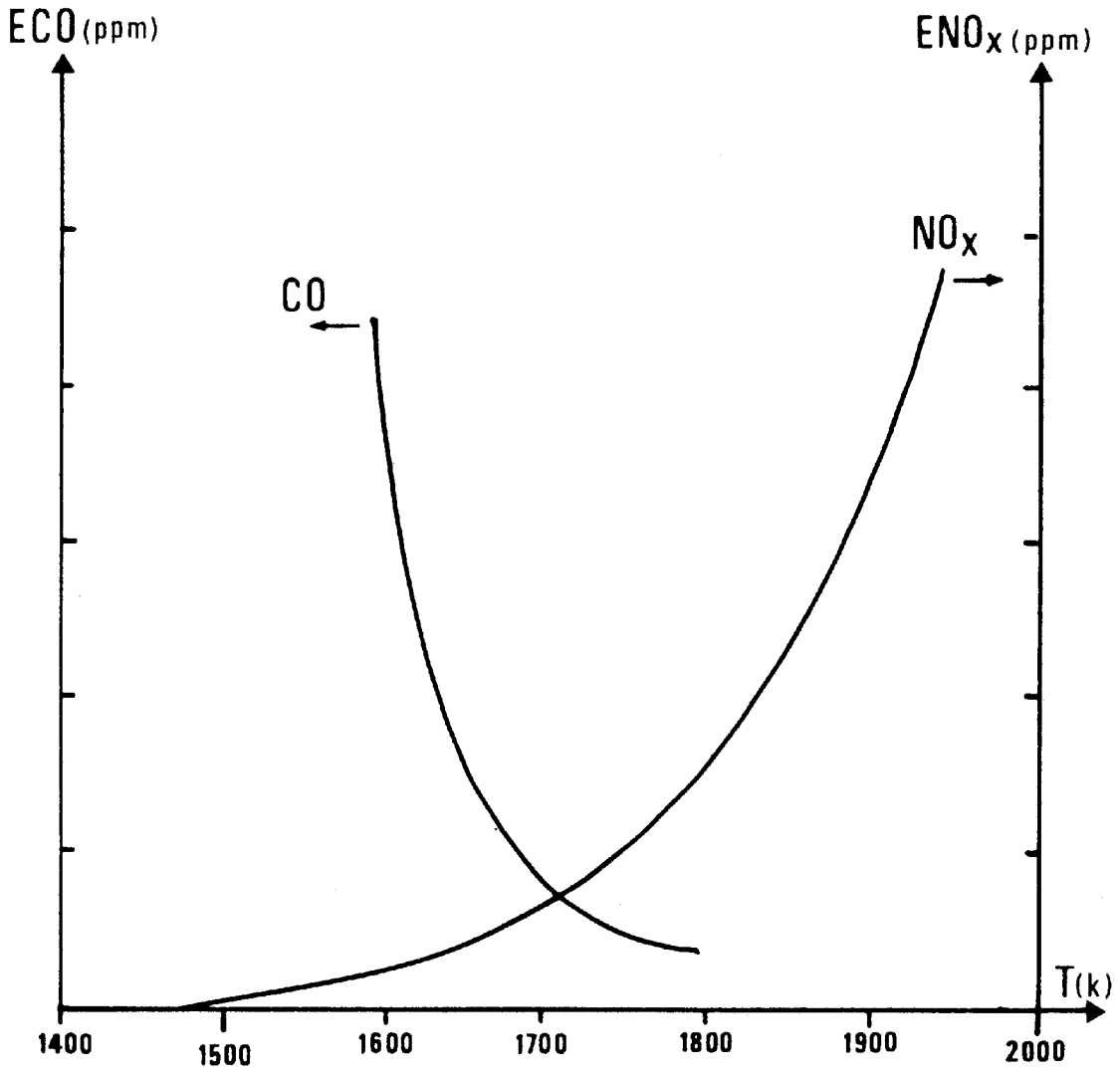
FIG. 1 shows the carbon monoxide (ECO) and nitrogen oxides emissions ($ENO_{x)}$ as a function of the temperature ($T_{(K)}$) under the operating conditions of a gas turbine.
Figure 2:
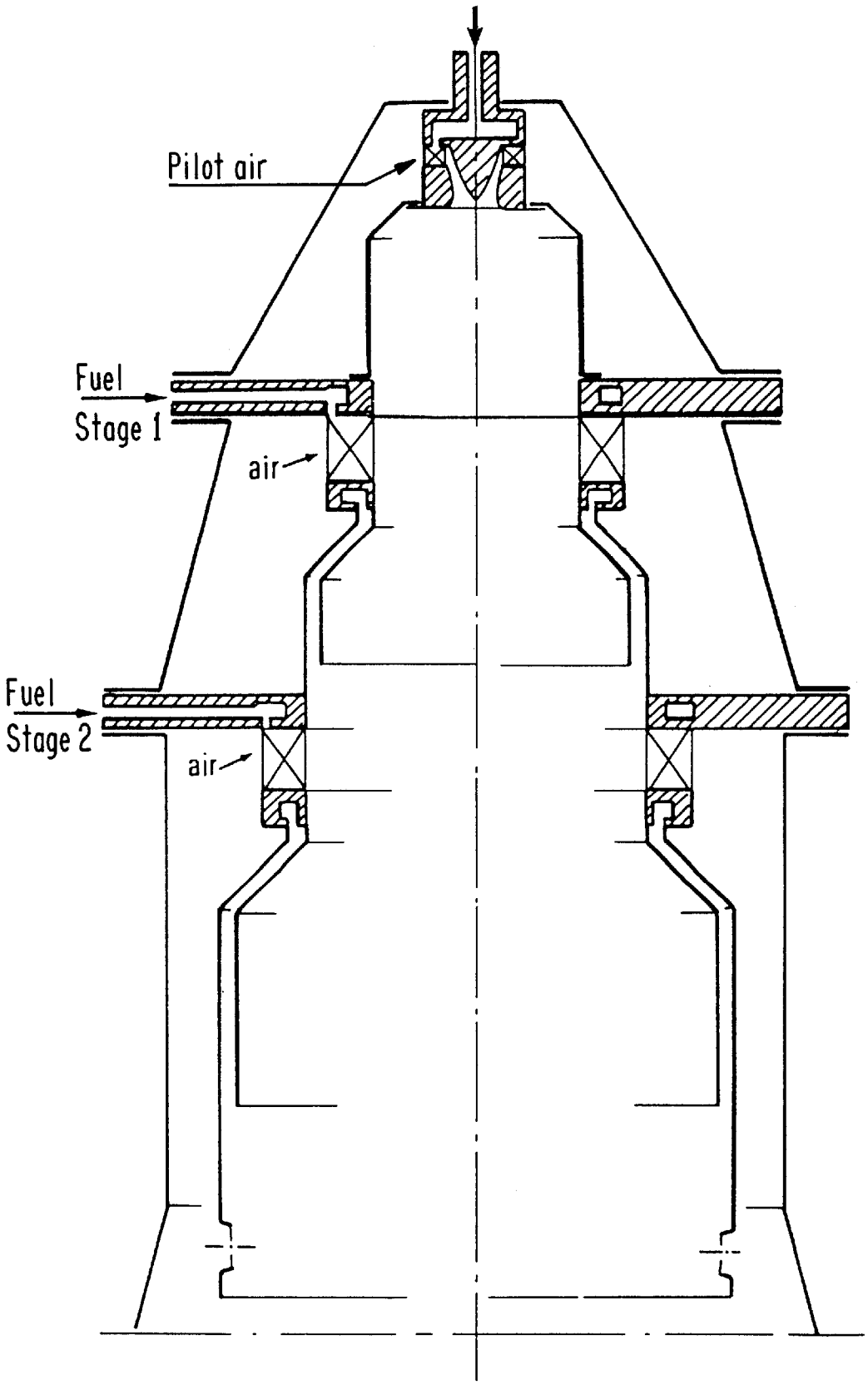
FIG. 2 shows a combustion chamber having a pilot stage followed by two other stages each having an air inlet and a fuel inlet.
Figure 3:
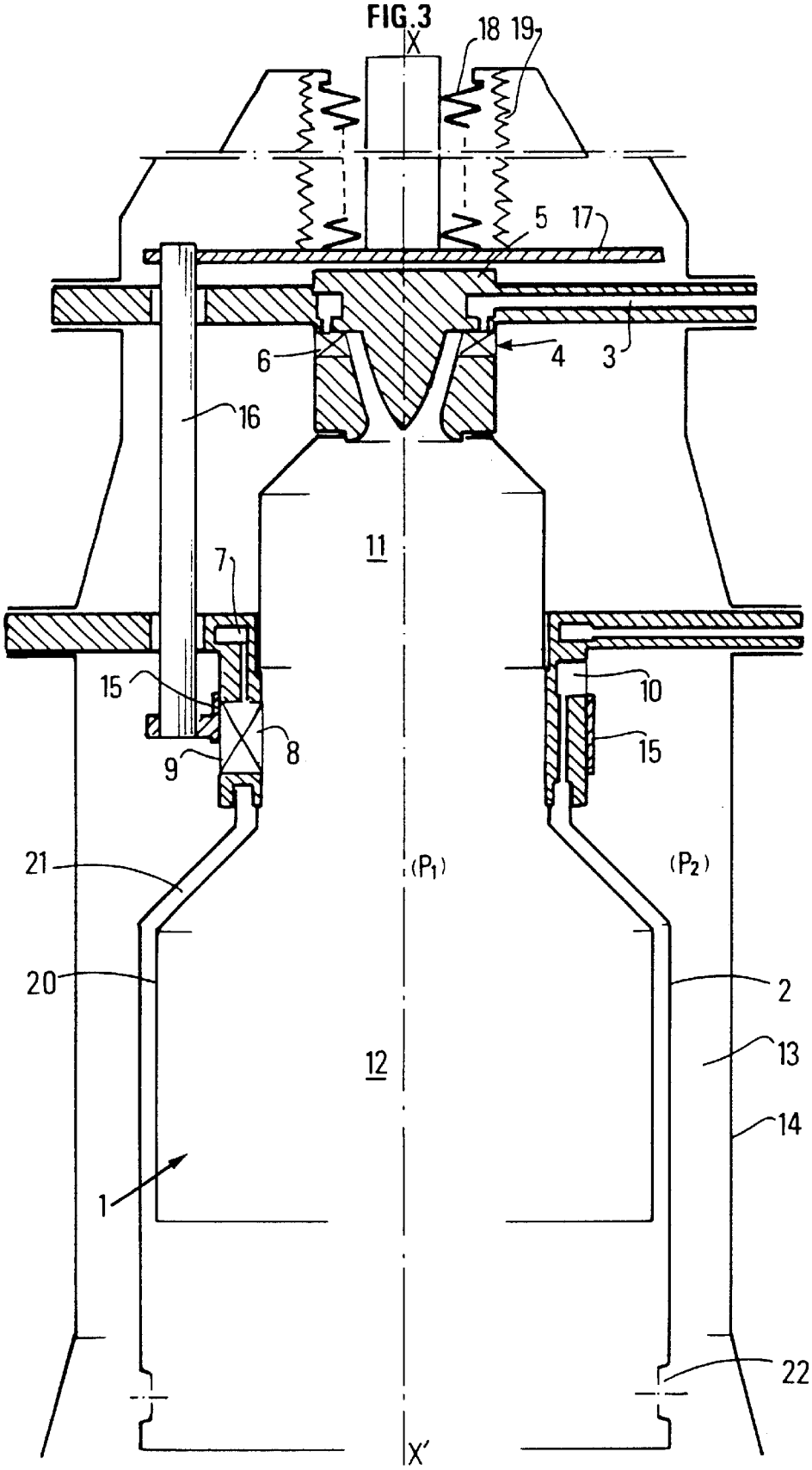
FIG. 3 is a longitudinal section of a combustion chamber according to an embodiment of the invention.

In FIG. 3, furnace 1 is delimited by an inner shell 2 having here two different diameters: the smaller diameter contains pilot combustion zone 11 and the zone with the larger diameter 12 is the main combustion zone.

Pilot combustion zone 11 provides combustion at idling speed and combustion can be maintained therein during the other operating speeds.

Injectors 3 delivering fuel such as natural gas, for example, and air injectors or inlets 4 open onto zone 11 respectively.

A bottom 5 is provided to delimit zone 11. Fuel 3 and air 4 inlets are situated close to bottom 5, circumferentially, and not far from the longitudinal axis XX' of the chamber. Pilot combustion zone 11 is a flame stability zone where a flame exists whatever the operating conditions.

Blades 6 creating a rotating motion of the air can be provided in the neighbourhood of air inlets 4.

Fuel injectors 3 can be situated in these blades without departing from the scope of the invention.

A given pressure P1 prevails in zone 11, as well as in zone 12.

Zone 12 thus has a larger diameter than zone 11. The main combustion takes place in this zone.

A second fuel injection means 7 is thus situated on the border between zones 11 and 12. Similarly, a second air injection means 8 is situated close to second fuel injector 7. Blades 9 can also be arranged in the neighbourhood of injectors 8. Means 7, 8 and 9 are situated on a circumference of inner shell 2, and several groups can be provided. Three groups are provided here, each one lying 120° apart.

Furthermore, air referred to as <<dilution air >>, i.e. air that does not take part in the combustion or in the cooling of the walls, can be introduced into inner shell 2, downstream from combustion zone 12, via suitable orifices 22.

The general air supply occurs through an annular space 13 delimited by inner shell 2 and an outer casing 14. A pressure P2 prevails in this space; this pressure is slightly higher than pressure P1, the difference being due to the pressure drops created by the various air inlets.

In the neighbourhood of air inlets 8, the present invention provides a flow control means that reacts to the pressure difference between the annular space (P2) and outside enclosure 14 where a pressure Po (~atmospheric pressure) prevails.

When the speed of the turbine increases, pressure P2 increases and pressure Po does not change; the pressure difference (P2−Po) thus increases and the flow control means reacts by allowing air inlets 8 to open wider.

More precisely, the flow control means comprises a shell ring 15 that can slide along axis XX' past openings 8 (preferably equipped with blades 9) and thus allow to vary the cross-section of flow of the air.

Corresponding openings are provided in shell ring 15 opposite openings 8 on inner shell 2.

Shell ring 15 is fastened, by any means known in the art, to the lower end of several rods 16. At the other end thereof, rods 16 bear a support plate 17 itself connected to a compression element 18. A pile of conical washers or springs can be provided therefore.

Bellows 19 or any other seal means are furthermore provided around compression element 18. Bellows 19 are a separation between the inner volume of the combustion chamber, where pressure P2 and P1 prevail, and the outer volume where pressure Po prevails.

Moreover, shell ring 15 can be provided with additional openings communicating space 13 with an annular space 21 inside inner shell 2. An additional shell 20 coaxial to shell 2 is therefore provided over part of the height of shell 2.

The height of shell 20 can correspond to combustion zone 12. Over this height, the air coming in through openings 10 and passing through annular space 21 will allow to discharge air downstream from combustion zone 12 while cooling the walls of said combustion zone 12. An acceptable mixture strength can thus be maintained in the main furnace, whatever the load. The main effect of bypass 21 is to limit the decrease in the mixture strength in furnace 1, notably at partial load.

Openings 10 are so designed that, at full load, no air passes therethrough (case of FIG. 4), whereas at partial or low load, some air passes into space 21 in order to be discharged downstream from combustion zone 12 while cooling the wall of shell 2.

Figure 4:
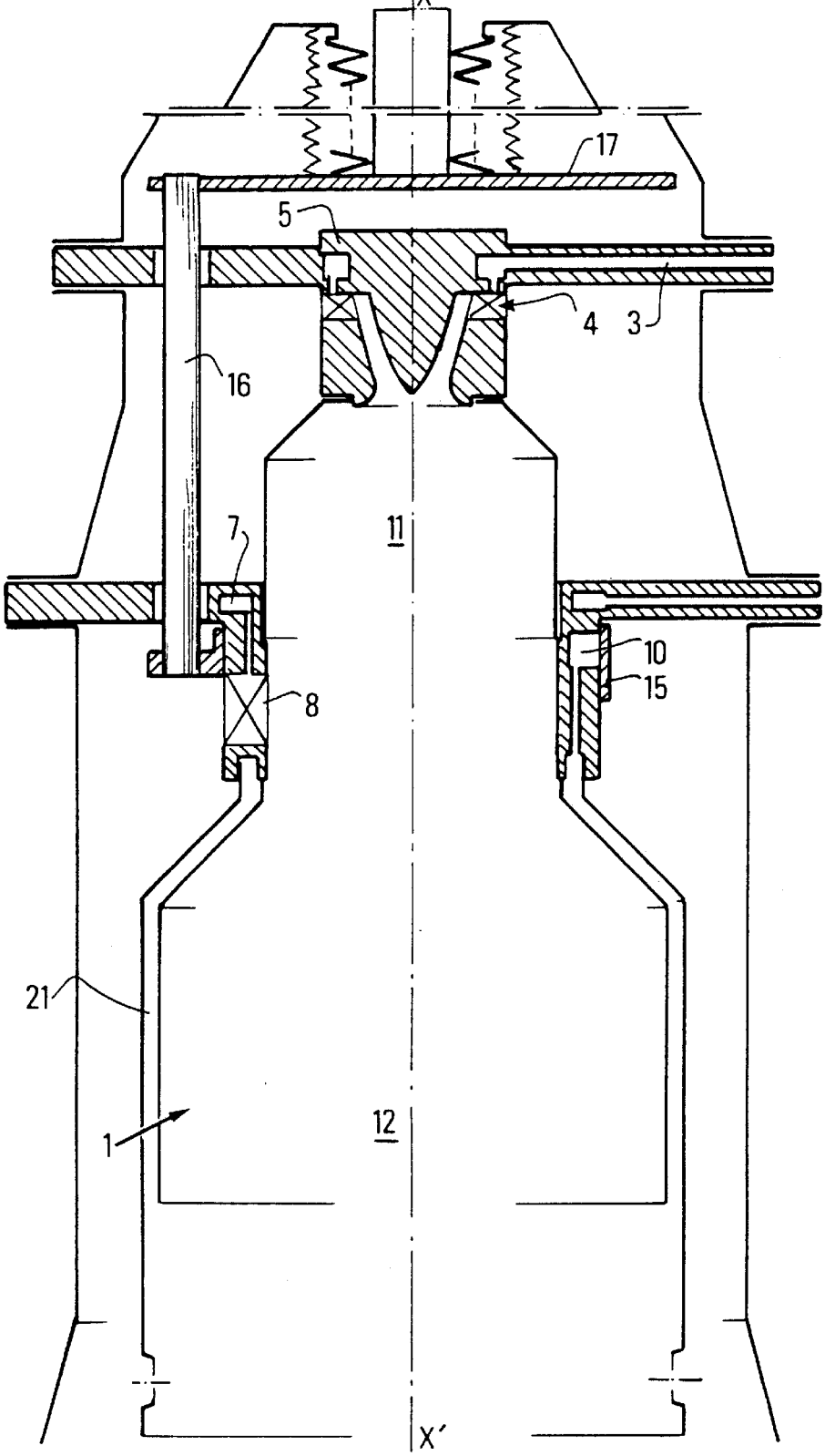
FIG. 4 is a longitudinal section of the combustion chamber of FIG. 3, in another operating position.

Operation of the assembly described above can be summed up as follows, by comparing respectively FIGS. 3 and 4.

In fact, in FIG. 3, the position of the various elements corresponds to an operation at about 50% of its maximum capacity. FIG. 4 shows the device working at 100% of its capacity.

When a lower power is required (idling speeds), the relative pressure (P2−Po) between annular space 13 and the outside of enclosure 14 allows limited opening of air inlets 8.

Simultaneously, openings 10 are rather wide open so that air can flow past space 21 and cool wall 20 without taking part in the combustion in zone 12. An acceptable mixture strength can thus be maintained therein and high CO emissions can be avoided.

When the turbine works at fill load, the relative pressure (P2−Po) is higher than in the aforementioned case, so that shell ring 15 is lifted and uncovers openings 8 more widely. A great flow of air can then enter combustion chamber 12. Simultaneously, openings 10 are closed, which prevents the air from entering annular space 21. A large amount of air is thus directly injected into main combustion zone 12, which limits the maximum mixture strength and prevents CO formation.

It thus appears that the combustion chamber according to the invention requires no specific mechanical device for controlling air inflows. Control takes place by itself, through the relative pressure in the combustion chamber and therefore according to the engine speed.

What is claimed is:

1. A gas-turbine combustion chamber comprising at least a pilot combustion zone into which at least a first pilot fuel injection means and an associated first oxidizer injection means open; a main combustion zone into which at least a second main fuel injection means and an associated second oxidizer injection means open, all of it being maintained under a pressure P2 in an enclosure, characterized in that it further comprises a mechanical means for controlling the second flow of oxidizer, that reacts to the pressure difference between the inside (P2) and the atmospheric pressure Po outside the enclosure, said pressure difference being directly linked with the engine speed.

2. A combustion chamber as claimed in claim 1, characterized in that said control means comprises at least a shutoff element sealing more or less second oxidizer inlets in the combustion chamber, several tie rods between the shutoff elements and a support element, a compression element, a bellows joint placed around the compression element and delimiting, with the support element, the volume at atmospheric pressure Po in relation to the enclosure under pressure.

3. A combustion chamber as claimed in claim 1, characterized in that the first fuel injection means and the first oxidizer injection means are situated substantially close to the longitudinal axis (XX') of the combustion chamber.

4. A combustion chamber as claimed in claim 1, characterized in that the second main fuel injection means and the second oxidizer injection means are placed on a circumference, downstream from the pilot injection zone in relation to the direction of propagation of the flame.

5. A combustion chamber as claimed in claim 1, characterized in that it further comprises a third oxidizer injection means opening into the combustion chamber downstream from the second oxidizer injection means in relation to the direction of propagation of the flame.

6. A combustion chamber as claimed in claim 5, characterized in that the means for controlling the second flow of oxidizer also allows to control the rate of inflow of the third oxidizer injection means.

7. A combustion chamber as claimed in claim 2, characterized in that the compression element comprises a pile of conical washers.

8. A combustion chamber as claimed in claim 2, characterized in that the compression element comprises at least one spring.

9. A combustion chamber as claimed in claim 1, characterized in that it comprises three zones in which the second main fuel injection means and the second main oxidizer injection means are grouped together, each zone lying 120° apart.

* * * * *